US005826955A

United States Patent [19]

Sanders et al.

[11] Patent Number: 5,826,955

[45] Date of Patent: Oct. 27, 1998

[54] MODULAR CABINETRY

[75] Inventors: Karen L. Sanders, 307 Woodlawn Pl., Lawrence, Kans. 66049; Denzel W. Gibbens, Tonganozie, Kans.; Thomas A. Thiel, Center Sandwich, N.H.

[73] Assignee: Karen L. Sanders, Lawrence, Kans.

[21] Appl. No.: 787,365

[22] Filed: Jan. 22, 1997

[51] Int. Cl.[6] ..... F16B 12/00

[52] U.S. Cl. ..... 312/111; 312/107; 312/223.6

[58] Field of Search ..... 312/107, 111, 312/223.6

[56] References Cited

U.S. PATENT DOCUMENTS

| | | | |
|---|---|---|---|
| 3,751,127 | 8/1973 | Black, Jr. et al. | 312/111 |
| 4,526,427 | 7/1985 | Boll et al. | 312/111 |

FOREIGN PATENT DOCUMENTS

| | | | |
|---|---|---|---|
| 2378474 | 9/1978 | France | 312/107 |
| 2803302 | 8/1979 | United Kingdom | 312/111 |

*Primary Examiner*—Peter M. Cuomo
*Assistant Examiner*—Gerald A. Anderson
*Attorney, Agent, or Firm*—Hovey, Williams, Timmons & Collins

[57] ABSTRACT

Modular cabinetry is provided comprising a plurality of interchangeably stackable cabinet units and at least one coupling member for restricting relative shifting of adjacent stacked units. Each cabinet unit includes at least one upwardly projecting top flange and at least one downwardly projecting bottom flange such that adjacent stacked units present a set of cooperating flanges comprising a bottom flange of the upper unit and a top flange of the lower unit. The coupling member includes a pair of oppositely facing grooves for receiving the set of flanges when the member is interposed between stacked units.

23 Claims, 2 Drawing Sheets

MODULAR CABINETRY

BACKGROUND OF THE INVENTION

1. Field of the Invention

The present invention relates generally to sectional or modular cabinetry for storing objects such as stereo and television equipment. More particularly, the invention concerns modular cabinet units which are interchangeably stacked on top of one another, with structure for releasably coupling the stacked units together so as to prevent relative shifting of the units.

2. Discussion of the Prior Art

Conventional modular cabinetry has numerous and various applications. For example, modular cabinetry is often used to compartmentalize closet space. Other types of modular cabinetry include sectional storage units which are variously arranged to form self-standing shelving, such as modular book shelves. In any case, the popularity of modular cabinetry is due in part to its versatility and ability to be arranged in various configurations. In this respect, a user may add or rearrange cabinet units as additional storage space is needed.

However, conventional modular cabinetry has several problems. For example, traditional cabinetry designs tend to sacrifice appearance for durability of the individual cabinet units or stability of the system when assembled, and vice versa. Further, traditional modular cabinetry is relatively unwieldy and difficult to assemble.

OBJECTS AND SUMMARY OF THE INVENTION

Responsive to these and other problems associated with conventional modular storage systems, an important object of the present invention is to provide a durable cabinetry system that has a simple and attractive design. A further object of the present invention is to provide an inexpensive yet highly versatile modular cabinetry system. It is also an object of the present invention to provide a modular cabinetry system that is also relatively more stable than conventional systems when the system is assembled.

The present invention is particularly concerned with modular cabinetry comprising several interchangeably stackable cabinet units. Accordingly, another object of the present invention is to provide stackable cabinet units which embody the above-noted objects. A further object of the present invention is to provide stackable cabinet units which may be easily and quickly arranged in various self-standing configurations. In this respect, yet another object of the present invention is to provide a separate coupling member which quickly yet positively interlocks adjacent stacked units. Additionally, an object the present invention is to provide cabinets units which may be stacked virtually side-by-side so as to minimize the amount of space consumed by several stacks of units and to eliminate the unsightly gap between adjacent stacks of units.

Another object of the present invention is to provide a plurality of modular cabinet units which are particularly useful in storing stereo and television equipment. Specifically, it is an object of the present invention to provide a modular system which is highly effective as a home entertainment center. Further, it is an object of the present invention to provide such cabinetry with structure for concealing the bulky and unsightly wiring of the television and stereo equipment.

In accordance with these and other objects evident from the following description of a preferred embodiment of the invention, the modular cabinetry comprises a plurality of interchangeably stackable cabinet units and at least one coupling member for restricting relative shifting of adjacent stacked units. Each unit includes at least one upwardly projecting top flange and at least one downwardly projecting bottom flange, such that adjacent stacked units present a set of cooperating flanges comprising a bottom flange of the upper unit and a top flange of the lower unit. The coupling member includes a pair of oppositely facing grooves for receiving the set of flanges when the member is interposed between stacked units.

Each cabinet unit preferably includes a top and bottom flange extending along each side thereof so that adjacent stacked units present two sets of flanges, with a pair of coupling members interposed therebetween. The preferred coupling member has an outer face which is substantially flush with the sides of the stacked units when the member is interposed between the units. It will be appreciated that this configuration allows adjacent stacks of units to be placed virtually against one another. In other words, the preferred coupling member does not project outwardly beyond the sides of the units, even though it is interposed between a set of flanges extending along the sides. Particularly, each of the flanges have an outer rounded edge, with the outer face of the coupling member extending tangentially between the rounded edges of the set of flanges.

The preferred cabinet units include a pair of side panels having upper and lower projections which define the respective upper and lower flanges. Further, the coupling member is relatively shorter than the depth of each unit (measured between the front and rear boundaries of the unit) so that an open gap is presented between each set of flanges. If desired, the coupling member may be spaced from the front boundaries of stacked units to present the gap at the front of the flanges, which gives the stack of units a "floating" appearance.

The inventive coupling member particularly includes a longitudinally extending shank portion having opposite sides. The shank portion flares outwardly adjacent one of its sides. The coupling member also includes a longitudinally extending lip portion projecting outwardly in opposite directions from the other side of the shank portion. The shank and lip portions cooperatively form the oppositely facing grooves which receive the sets of flanges.

Preferably, the lip portion projects perpendicularly from the side of the shank portion. The preferred shank portion flares symmetrically, arcuately outwardly adjacent its other side.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENTS

Figure 1:
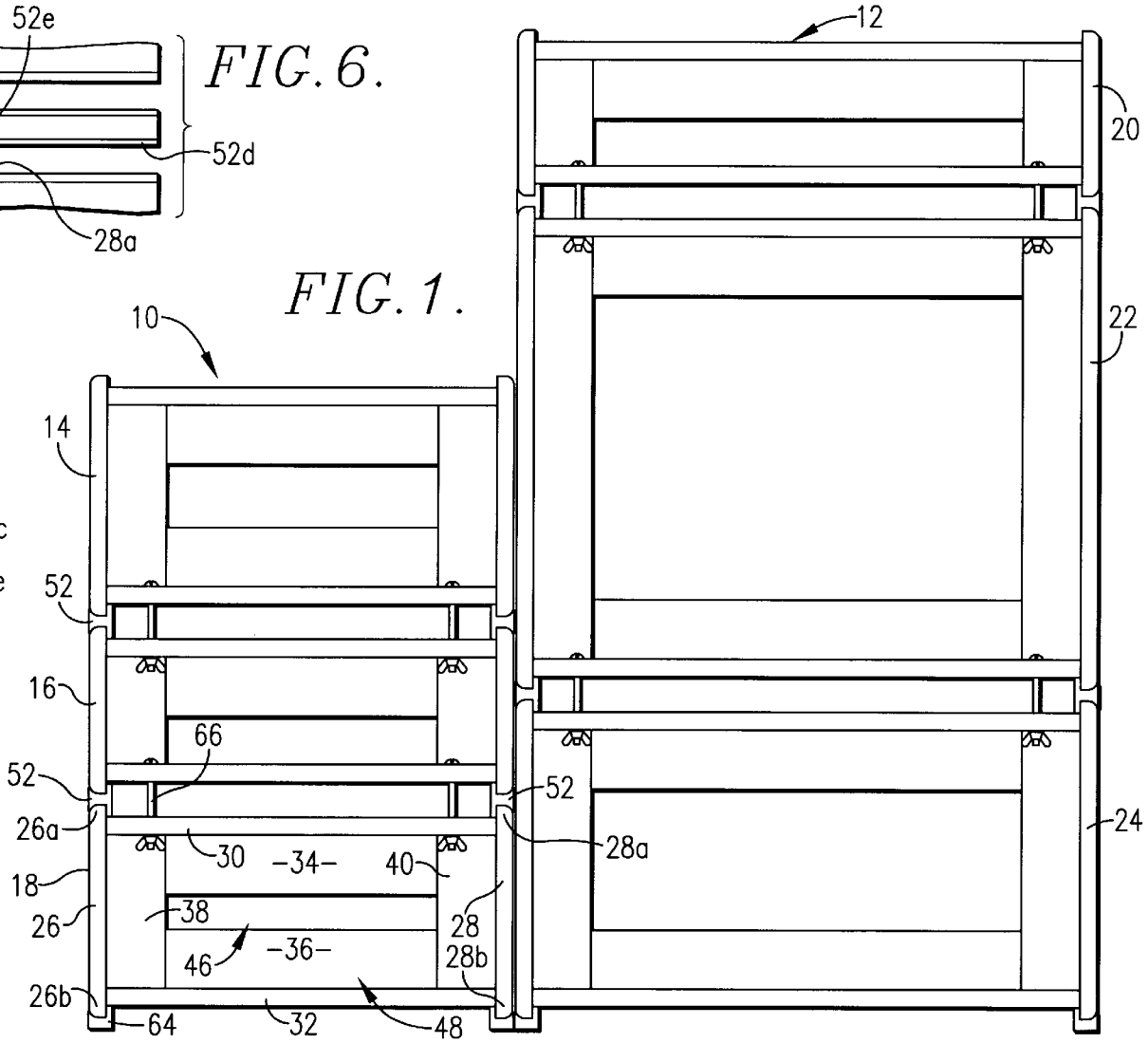
FIG. 1 is a front elevational view of two stacks of variously dimensioned cabinet units constructed in accordance with the principles of the present invention, particularly illustrating the two stacks located virtually side-by-side.

Turning initially to FIG. 1, the modular cabinetry selected for illustration is arranged in two side-by-side stacks, generally designated by the numerals 10 and 12, each including three cabinet units constructed in accordance with the principles of the present invention. Particularly, the relatively shorter stack 10 is formed of cabinet units 14,16,18, while the right stack 12 is formed of cabinet units 20,22,24. The cabinet units forming the right stack 12 are wider than the units forming the left stack 10. As will be indicated below, the units 14,16,18 of the left stack are not interchangeable with the units 20,22,24 of the right stack. However, each stack may be rearranged in any desired configuration. For example, the relatively short, top unit 20 of the right stack may be placed between the other two units 22 and 24, if so desired.

The illustrated cabinet units 14,16,18,20,22,24 are particularly useful in storing various stereo and television equipment. For example, a television may be stored within the relatively large cabinet unit 22 of the right stack 12. Accordingly, the illustrated modular cabinetry may be used as a highly versatile home entertainment center, with individual cabinet units that may be arranged and added or removed as desired. It will be appreciated, however, that the principles of present invention are equally applicable to various other storage systems. For example, it is entirely within the ambit of the present invention to store various other objects within the units.

Figure 4:
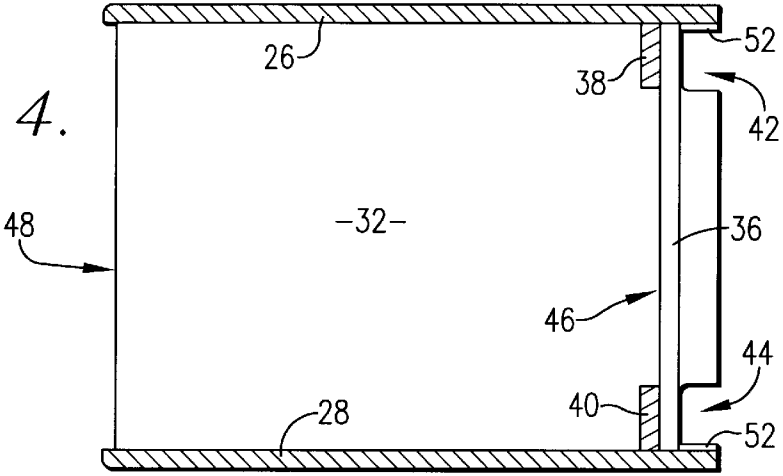
FIG. 4 is a horizontal sectional view of the lower cabinet unit shown in FIG. 2, particularly illustrating the openings along the rear side of the unit for receiving the wires of the various stereo and television components stored in the stacked units.

Although the cabinet units 14,16,18,20,22,24 each have a different height, and the units of the left stack 10 are narrower than the units of the right stack, they are otherwise similarly configured. Thus, for the sake of brevity, only the lowermost cabinet unit 18 of the left stack 10 will be described in detail, with the understanding that the other units are similarly constructed, except for the noted differences. The cabinet unit 18 includes a pair of opposite side panels 26 and 28 and vertically spaced top and bottom panels 30 and 32 extending between the side panels. The panels 26,28,30,32 are secured to one another by suitable means, such as mechanical fasteners, glue, etc. As shown in FIG. 4, the side panels 26 and 28 define side, front and rear boundaries of the unit 18. The top and bottom panels 30 and 32 extend forwardly from the rear boundary of the unit but terminate short of the front boundary (see also FIG. 3).

The cabinet unit 18 further includes a pair of horizontal braces 34 and 36 extending between the side panels 26 and 28, and a pair of vertical braces 38 and 40 extending between the top and bottom panels 30 and 32 (see FIGS. 1 and 4). Each brace comprises a generally flat board that is secured to the adjacent panels by suitable means, such as mechanical fasteners, glue, etc. Preferably, the braces are likewise secured to one another. The braces 34,36,38,40 are located near the rear of the unit 18, with the vertical braces 38,40 being positioned immediately in front of the horizontal braces 34,36. The top and bottom panels 30 and 32 each include two cut-out openings or slots 42 and 44 (only the slots in the bottom panel 32 being shown in FIG. 4) extending inwardly from the rear boundary of the unit 18 in vertical alignment with the braces 38 and 40, respectively, for purposes described below. As perhaps best shown in FIG. 1, the braces 34,36,38,40 cooperatively circumscribe the interior of the unit 18 to define a relatively constricted rear opening 46. It will be noted that the relatively shorter cabinet units 16 and 20 include only one horizontal brace so that the rear openings of the units are not closed off.

The panels 26,28,30,32, on the other hand, cooperatively define an unrestricted front opening 48. Accordingly, a television or stereo component (not shown) may be placed in the cabinet unit with the display or front of the component being visible through the front opening 48. The wires (not shown) typically projecting from the rear of the component may be placed through the rear opening 46 and, if necessary, extended along the vertical or horizontal braces of the stacked units 14,16,18 to other components, the wall outlet (not shown), etc. The slots 42 and 44 defined in the top and bottom panels 30 and 32 allow the wiring to be extended between the vertical braces of adjacent stacked units. Accordingly, the braces also serve to conceal the wiring of the television and stereo equipment, which otherwise tends to be unsightly. If desired, an adjustable strap (not shown) having hook-and-loop fastening means on opposite sides thereof may be attached to the rear faces of the braces to hold the wiring in place. It will be appreciated that the rear opening 46 of the cabinet unit 18 also facilitates ventilation of the cabinet unit 18 and thereby minimizes the buildup of heat generated by the equipment stored within the unit.

Figure 7:
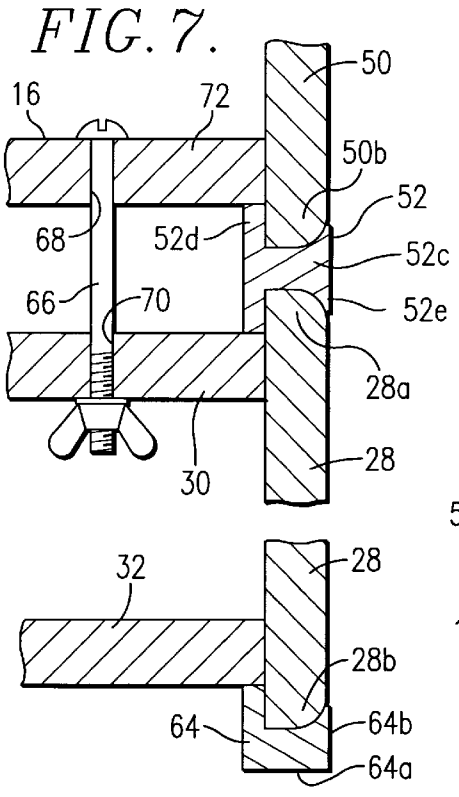
FIG. 7 is an enlarged fragmentary, vertical sectional view of the cabinet units shown in FIG. 2, particularly illustrating the outer faces of the coupling member and foot flush with the sidewalls of the units.

The side panels 26 and 28 project slightly beyond the top and bottom panels 30 and 32 to present a pair of upper flanges 26*a* and 28*a* and a symmetrical pair of lower flanges 26*b* and 28*b*. Each flange has an inner right-angular edge and an outer rounded edge (see FIG. 7), for purposes which will subsequently be described. The flanges 26*a*,26*b*,28*a*, 28*b* extend along the side boundaries entirely between the front and rear boundaries of the unit 18. In this respect, adjacent stacked units present two sets of flanges, each set consisting of one of the upper flanges of the lower unit and the oppositely projecting, vertically aligned lower flange of the upper unit. As shown in FIG. 7, the side panel 28 of the cabinet unit 18 and the aligned side panel 50 of the unit 16 cooperatively present the set of flanges 28*a* and 50*b*. Each set of flanges conveniently provide a common location for interlocking adjacent stacked units.

Figure 5:
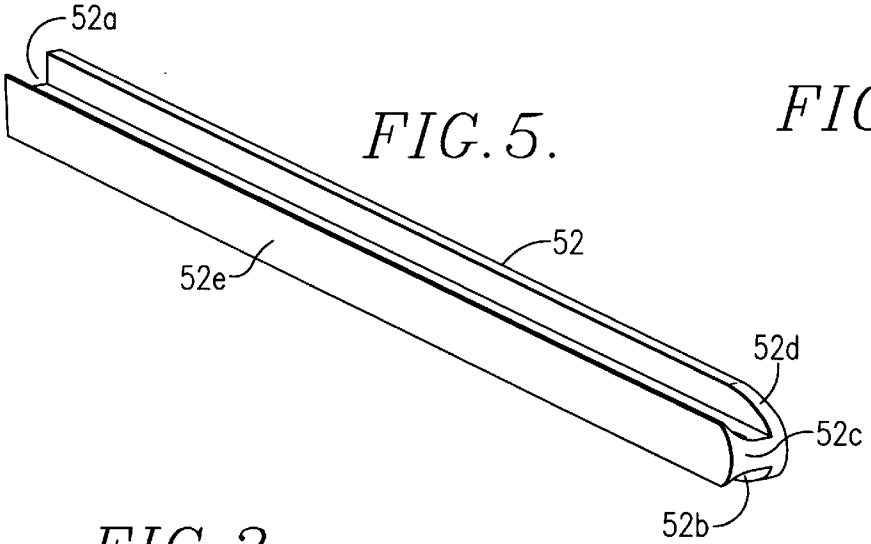
FIG. 5 is an enlarged perspective view of one of the coupling members.

Accordingly, an elongated coupling member 52 is provided for interlocking adjacent stacked units to one another for preventing relative shifting of the units. The coupling member 52 presents a pair of oppositely facing grooves 52*a* and 52*b* (see FIG. 5) for receiving the set of flanges of the adjacent units. The illustrated coupling member 52 comprises a longitudinally extending shank portion 52*c* that flares outwardly adjacent one of its sides (see FIG. 7). A lip portion 52*d* projects perpendicularly from the other side of the shank portion 52*c* and cooperates therewith to define the oppositely facing grooves 52*a* and 52*b*. As perhaps best shown in FIG. 7, the shank portion 52*c* flares symmetrically outwardly at the end opposite the lip portion 52*d* and presents inner arcuate faces that have generally the same radius of curvature as the rounded outer edges of the flanges. The locus of each arcuate face is spaced sufficiently near the flared side of the shank portion 52*c* that the outer face 52*e* tangentially intersects the arcuate face.

Figure 6:
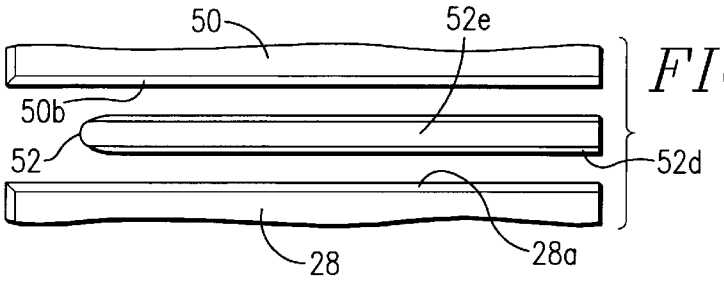
FIG. 6 is a fragmentary, exploded side view of the cabinet units shown in FIG. 2.

When the coupling member 52 is placed between adjacent stacked units, such as the units 18 and 16 shown in FIGS. 6 and 7, the flanges 28*a* and 50*b* are received within the oppositely facing grooves 52*a* and 52*b*, respectively. Particularly, the coupling member 52 extends around both edges of the flanges 52*a* and 52*b* to restrict relative lateral shifting of the units 16 and 18. It will be appreciated that the frictional interengagement between the coupling member 52 and flanges 50*b* and 28*a* restricts relative fore-and-aft shifting of the units 16 and 18. The illustrated coupling member 52, however, does more than simply interlock the cabinet units 16 and 18, it also transfers the load of the upper unit 16 to the lower unit 18. That is, the weight of the upper cabinet units 14 and 16 and objects stored therein is transferred from the unit 16 to the unit 18 by the coupling members 52 interposed between the units 16 and 18. Accordingly, the flanges are preferably located at the side boundaries of the units to afford the greatest degree of stability to the stack of units. Of course, if the flanges were spaced inwardly from the side boundaries, a portion of the load of the upper unit would be acting outside the support of that unit which inherently leads to a less stable cabinetry system.

Figure 3:
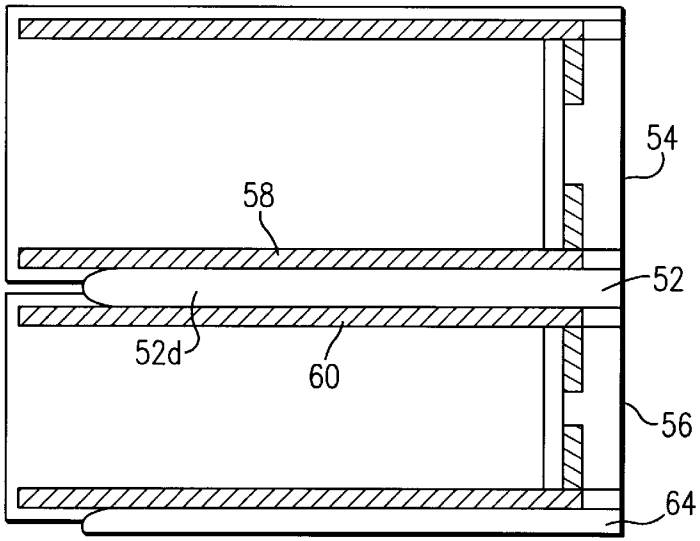
FIG. 3 is a vertical sectional view of another pair of stacked units, particularly illustrating the lip portion of the coupling member extending between the top panel of the lower unit and the bottom panel of the top unit.

As shown in FIG. 3, another stacked pair of cabinet units 54 and 56 is shown in vertical section to illustrate, among other things, the lip portion 52*d* of the coupling member 52 extending between the lower panel 58 of the upper unit 54 and the upper panel 60 of the lower unit 56 to assist with transferring the load of the upper unit directly to the lower unit (see also FIG. 7). This configuration also promotes interlocking of the cabinet units 54 and 56 and coupling member 52, as the lip portion abuttingly engages the panels 58*b* and 60 rather than floating freely therebetween.

As particularly shown in FIG. 7, the outer face 52*e* of the coupling member 52 lies substantially flush with the sides of the cabinet units 16 and 18 (i.e., outer faces of the side panels 50 and 28). This configuration is provided in the illustrated embodiment by the rounded outer edges of the flanges 50*b* and 28*a* and the corresponding flared side of the shank portion 52*c*. Particularly, with the arcuate faces of the shank portion 52*c* having a radius of curvature that substantially matches the rounded outer edges of the flanges 50*b* and 28*a*, the outer face 52*e* of the coupling member 52*e* extends tangentially between the rounded edges of the flanges. Accordingly, the coupling member 52 does not interfere with the side-by-side placement of the stacks 10 and 12, even though the flanges 50*b* and 28*a* extend along the side boundaries. In other words, the flanges 50*b* and 28*a* are located advantageously along the side boundaries of the units 16 and 18 for enhancing stability, yet the coupling member 52 does not project outwardly from the stack 10 so that the stacks 10 and 12 may be placed in the illustrated side-by-side arrangement.

Figure 2:
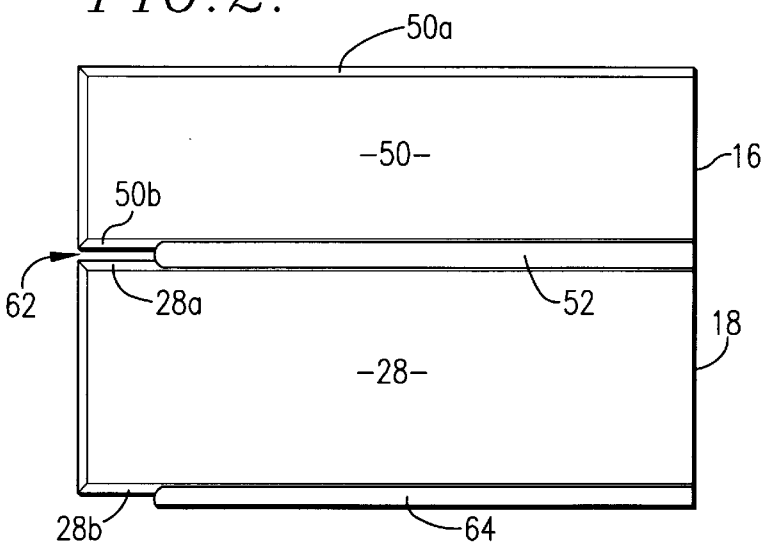
FIG. 2 is a side elevational view of the left stack of units shown in FIG. 1 with the upper unit removed, particularly illustrating the placement of the coupling member to create the perception that the upper unit is floating.

As shown in FIG. 2, the coupling member 52 is relatively shorter than the side panels 28 and 50, and accordingly, a gap 62 is presented between the flanges 28*a* and 50*b*. Preferably, the coupling member 52 is spaced from the front boundary of the units 16 and 18 so that the gap 62 is located at that boundary (the flat end of the coupling member 52 is preferably placed flush with the rear boundary of the units 16 and 18). It will be appreciated that when the stack of units is viewed from the front, the coupling member 52 is not readily visible, and the gap between the flanges 28*a* and 50*b* gives the perception that the upper unit 16 "floats" above the lower unit 18.

Because the cabinet units 14,16,18 are interchangeable, the lower flanges 26*b* and 28*b* of the lowermost unit 18 are identical to the lower flanges of the other units. However, the flanges 26*b* and 28*b* of the lowermost unit 18 must be supported by the floor. It will be appreciated that the lower flanges of a cabinet unit may become damaged if placed directly upon the floor to support the stack. Accordingly, a plurality of feet 64 are provided for supporting the lower flanges 26*b* and 28*b* above the floor (see FIG. 1). As shown in FIG. 7, each foot 64 has a longitudinally extending groove for receiving the lower flange 28*b*, and an opposite, generally flat, floor-engaging face 64*a*. The foot 64 is designed similar to the coupling member 52 so that its outer face 64*b* lies substantially flush with the side of the lowermost unit 18. Thus, the foot 64 does not interfere with the side-by-side placement of the stacks 10 and 12. Further, the foot 64 is relatively shorter than the side panel 28, as shown in FIG. 2, to give the "floating" perception described above.

As shown in FIG. 1, a pair of wing-nut and bolt assemblies 66 are provided between adjacent stacked units for releasably securing the units to one another. With respect to FIG. 7, the assembly 66 is received within vertically aligned openings 68 and 70 defined within the bottom panel 72 of the upper unit 16 and the top panel 30 of the lower unit 18 (see FIG. 7), respectively. The assembly 66 supplements the coupling members 52 and thereby further restricts relative shifting of the units 16 and 18.

The cabinet units 14,16,18,20,22,24, coupling members 52 and feet 64 are preferably formed of wood, although it is entirely within the scope of the present invention to form these components of other materials. For example, the cabinet units, coupling members and feet may be formed of a plastic material, with each unit comprising an integrally molded body.

In use, the cabinet units of each stack may be arranged in any desired configuration. Assembly simply requires the feet 64 to be placed between the floor and the lowermost cabinet unit. Thereafter, additional cabinet units are stacked on top of the lowermost unit simply by placing a pair of coupling members 52 on the exposed, uppermost flanges of the stack and then stacking the additional unit on the stack, with the lower flanges of the additional unit being received within the corresponding grooves of the coupling members. If desired, a pair of wing-nut and bolt assemblies 66 may be attached between the bottom panel of the additional unit and the top panel of the adjacent unit. Because the coupling members 52 are not secured to the cabinet units, removal of one of the cabinet units or rearrangement of the units is likewise quite simple.

As should be apparent from the foregoing description, the construction of the cabinet units of each stack are very similar. In fact, the only significant variation in construction between the units of each stock is the height of the side panels and vertical braces. Thus, the top and bottom panels and horizontal braces are similar on each unit, which of course reduces manufacturing time and costs. Further, because the units have symmetrical flanges (the flanges project from the top or bottom panels the same distance and are similarly shaped), the space defined between the bottom panel of the upper unit and the top panel of the lower unit is the same for each pair of adjacent stacked units (see FIG. 1). This symmetry also allows each unit to be flipped over, if necessary. For example, the cabinet unit 18 may be flipped over so that the panel 32 is at the top and the panel 30 is at the bottom (inverted relative to FIG. 1).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the flanges may be formed as separate elements attached to the top and bottom of the units, rather than being formed as projections of the side panels. If desired, the modular cabinetry could include various other types of storage units, such as a table top (not shown) extending between spaced units or stacks of units.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. Modular cabinetry comprising:

a plurality of interchangeably stackable units, each including at least one upwardly projecting top flange and at least one downwardly projecting bottom flange such that adjacent stacked units present a set of cooperating flanges comprising a bottom flange of the upper unit and a top flange of the lower unit; and at least one coupling member including a pair of oppositely facing grooves for receiving the set of flanges when the member is interposed between stacked units so as to restrict relative shifting of the units, each of said units having a pair of vertically spaced top and bottom panels and a rear boundary from which the top and bottom panels extend, each of said units including at least one upright brace extending between said top and bottom panels adjacent the rear boundary of the unit, said top and bottom panels including at least one open slot adjacent the rear boundary of the unit, with the slot being vertically aligned with said at least one upright brace.

2. Modular cabinetry as claimed in claim 1, each of said units having a pair of spaced top flanges and a pair of spaced bottom flanges such that adjacent stacked units present two sets of flanges, with a pair of said coupling members interposed therebetween.

3. Modular cabinetry as claimed in claim 2, each of said units presenting a pair of opposite side boundaries, each of said coupling members having an outer face which is substantially flush with the side boundaries of adjacent stacked units when the member is interposed between the units.

4. Modular cabinetry as claimed in claim 3, said pair of top flanges being vertically aligned with said pair of bottom flanges, said grooves of each of the coupling members being configured to receive the oppositely projecting, aligned flanges of each of the sets.

5. Modular cabinetry as claimed in claim 4, each of said flanges extending along a respective one of said side boundaries.

6. Modular cabinetry as claimed in claim 5, each of said flanges having an outer rounded edge, said outer face of each of the coupling members extending tangentially between the rounded edges of the set of flanges when the member is interposed between adjacent stacked units.

7. Modular cabinetry as claimed in claim 6, each of said coupling members being relatively shorter than the flanges such that an open gap is presented between each set of flanges when the coupling member is interposed between adjacent stacked units.

8. Modular cabinetry as claimed in claim 7, each of said units presenting a front boundary with said flanges extending therefrom, each of said coupling members being spaced from the front boundary when interposed between adjacent stacked units so that the open gap is presented adjacent the front boundary of each of the units.

9. Modular cabinetry as claimed in claim 6, each of said units having a pair of spaced side panels defining the side boundaries thereof.

10. Modular cabinetry as claimed in claim 9, said side panels presenting upper and lower projections which define said pairs of top and bottom flanges.

11. Modular cabinetry as claimed in claim 10, said top and bottom panels being located between said side panels.

12. Modular cabinetry comprising:

a plurality of interchangeably stackable units, each including at least one upwardly projecting top flange and at least one downwardly projecting bottom flange such that adjacent stacked units present a set of cooperating flanges comprising a bottom flange of the upper unit and a top flange of the lower unit; and at least one coupling member including a pair of oppositely facing grooves for receiving the set of flanges when the member is interposed between stacked units so as to restrict relative shifting of the units, each of said units having a pair of spaced top flanges and a pair of spaced bottom flanges such that adjacent stacked units present two sets of flanges, with a pair of said coupling members interposed therebetween, each of said units presenting a pair of opposite side boundaries, each of said coupling members having an outer face which is substantially flush with the side boundaries of adjacent stacked units when the member is interposed between the units said pair of top flanges being vertically aligned with said pair of bottom flanges, said grooves of each of the coupling members being configured to receive the oppositely projecting, aligned flanges of each of the sets, each of said flanges extending along a respective one of said side boundaries, each of said flanges having an outer rounded edge, said outer face of each of the coupling members extending tangentially between the rounded edges of the set of flanges when the member is interposed between adjacent stacked units, each of said units having a pair of spaced side panels defining the side boundaries thereof, said side panels presenting upper and lower projections which define said pairs of top and bottom flanges, each of said units having a pair of vertically spaced top and bottom panels extending between said side panels, each of said units presenting a rear boundary with said top and bottom panels extending therefrom, each of said units including at least one upright brace extending between said top and bottom panels adjacent the rear boundary of the unit, said top and bottom panels including at least one open slot adjacent the rear boundary of the unit, with the slot being vertically aligned with said at least one upright brace.

13. Modular cabinetry as claimed in claim 12, and means for releasably securing adjacent stacked units to one another.

14. Modular cabinetry comprising:

a plurality of interchangeably stackable cabinet units, each presenting a pair of opposite sides and including a pair of upwardly projecting top flanges and a pair of downwardly projecting bottom flanges, with each of the flanges extending along a respective side of the unit, such that adjacent stacked units present sets of cooperating flanges comprising a bottom flange of the upper unit and an oppositely projecting, aligned top flange of the lower unit; and a plurality of coupling members, each including a pair of elongated, oppositely facing grooves for receiving one of the sets of flanges when the member is interposed between stacked units so as to restrict relative shifting of the units, each of said units having a pair of vertically spaced top and bottom panels and a rear boundary from which the top and bottom panels extend, each of said units including at least one upright brace extending between said top and bottom panels adjacent the rear boundary of the unit, said top and bottom panels including at least one open slot adjacent the rear boundary of the unit, with the slot being vertically aligned with said at least one upright brace.

15. Modular cabinetry as claimed in claim 14, each of said coupling members having an outer face which is substantially flush with the sides of adjacent stacked units when the member is interposed between the units.

16. Modular cabinetry as claimed in claim 15, each of said flanges having an outer rounded edge, said outer face of each of the coupling members extending tangentially between the rounded edges of the set of flanges when the member is interposed between adjacent stacked units.

17. Modular cabinetry as claimed in claim 16, each of said coupling members being relatively shorter than the flanges such that an open gap is presented between each set of flanges when the coupling member is interposed between adjacent stacked units.

18. Modular cabinetry as claimed in claim 17, each of said units presenting a front boundary with said flanges extending therefrom, each of said coupling members being spaced from the front boundary when interposed between adjacent stacked units so that the open gap is presented adjacent the front boundary of each of the units.

19. Modular cabinetry as claimed in claim 16, each of said units having a pair of spaced side panels defining the sides thereof.

20. Modular cabinetry as claimed in claim 19, said side panels presenting upper and lower projections which define said pairs of top and bottom flanges.

21. Modular cabinetry as claimed in claim 20, said top and bottom panels being located between said side panels.

22. Modular cabinetry comprising:

a plurality of interchangeably stackable cabinet units, each presenting a pair of opposite sides and including a pair of upwardly projecting top flanges and a pair of downwardly projecting bottom flanges, with each of the flanges extending along a respective side of the unit, such that adjacent stacked units present sets of cooperating flanges comprising a bottom flange of the upper unit and an oppositely projecting, aligned top flange of the lower unit; and a plurality of coupling members, each including a pair of elongated, oppositely facing grooves for receiving one of the sets of flanges when the member is interposed between stacked units so as to restrict relative shifting of the units, each of said coupling members having an outer face which is substantially flush with the sides of adjacent stacked units when the member is interposed between the units, each of said flanges having an outer rounded edge, said outer face of each of the coupling members extending tangentially between the rounded edges of the set of flanges when the member is interposed between adjacent stacked units, each of said units having a pair of spaced side panels defining the sides thereof, said side panels presenting upper and lower projections which define said pairs of top and bottom flanges, each of said units having a pair of vertically spaced top and bottom panels extending between said side panels, each of said units presenting a rear boundary with said top and bottom panels extending therefrom, each of said units including at least one upright brace extending between said top and bottom panels adjacent the rear boundary of the unit, said top and bottom panels including at least one open slot adjacent the rear boundary of the unit, with the slot being vertically aligned with said at least one upright brace.

23. Modular cabinetry as claimed in claim 22, and means for releasably securing adjacent stacked units to one another.

* * * * *